US009572374B2

(12) United States Patent
Gabbay

(10) Patent No.: US 9,572,374 B2
(45) Date of Patent: Feb. 21, 2017

(54) ATOMIZER COVER WITH SIDE AIR INLET HOLE

(71) Applicant: DACOLN LLC, Dallas, TX (US)

(72) Inventor: Eyal Gabbay, Dallas, TX (US)

(73) Assignee: DACOLN LLC, Dallas, TX (US)

( * ) Notice: Subject to any disclaimer, the term of this patent is extended or adjusted under 35 U.S.C. 154(b) by 41 days.

(21) Appl. No.: 14/481,898

(22) Filed: Sep. 9, 2014

(65) Prior Publication Data

US 2015/0257449 A1 Sep. 17, 2015

Related U.S. Application Data

(63) Continuation-in-part of application No. 29/500,467, filed on Aug. 25, 2014, and a continuation-in-part of application No. 29/500,466, filed on Aug. 25, 2014.

(30) Foreign Application Priority Data

Mar. 15, 2014 (CN) ..... 2014 3 00516139
Mar. 15, 2014 (CN) ..... 2014 3 00516158

(51) Int. Cl.
*H05B 3/40* (2006.01)
*A24F 47/00* (2006.01)

(52) U.S. Cl.
CPC ..... *A24F 47/008* (2013.01)

(58) Field of Classification Search
CPC ..... A24F 47/008; A24F 47/00
USPC ..... 219/201, 482; 131/187, 195, 202, 203, 131/328, 329; 128/200.23, 202.21, 203.23
See application file for complete search history.

(56) References Cited

U.S. PATENT DOCUMENTS 4,945,929 A * 8/1990 Egilmex ..... A24F 47/002 128/200.21
6,164,287 A * 12/2000 White ..... A24F 47/008 131/194
2005/0016550 A1* 1/2005 Katase ..... A24F 47/002 131/194
2005/0067503 A1* 3/2005 Katase ..... A61M 15/02 239/373
2006/0196518 A1* 9/2006 Hon ..... A24F 47/002 131/360
2008/0023003 A1* 1/2008 Rosenthal ..... A61M 11/041 128/203.26
2009/0260642 A1* 10/2009 Monsees ..... A24F 47/006 131/194

(Continued)

FOREIGN PATENT DOCUMENTS

CN 202068930 * 12/2011 ..... A24F 47/00
GB 191225017 A * 0/1913 ..... A24F 1/08
KR WO 2013151295 A1 * 10/2013 ..... A24F 47/008

*Primary Examiner* — Thien S Tran
(74) *Attorney, Agent, or Firm* — Lewis Brisbois Bisgaard & Smith LLP

(57) ABSTRACT

An atomizer cover which is made of glass, plastic, silicone, metal or glass-lined metal for a vaporizing device wherein a side air inlet hole through the atomizer cover is located at a lower portion of the cover, wherein upon assembly of the cover with an atomizer and an atomizer base, the side air inlet hole is located near the atomizer and atomizer base, at or below the atomizer cup level, which creates a vortex of air to increase the efficiency in pulling of the aerosol or vapor from the interior of the atomizer cover, while cooling down the aerosol or vapor which is then inhaled by the user.

22 Claims, 4 Drawing Sheets

(56) References Cited

U.S. PATENT DOCUMENTS

| | | | | |
|---|---|---|---|---|
| 2014/0261500 | A1* | 9/2014 | Park | A24F 47/008 131/329 |
| 2015/0020826 | A1* | 1/2015 | Liu | A24F 47/008 131/329 |

* cited by examiner

ATOMIZER COVER WITH SIDE AIR INLET HOLE

CROSS-REFERENCE TO RELATED APPLICATIONS

This application is a continuation in part of and claims priority to and the benefit of U.S. Design patent application Ser. No. 29/500,467, entitled "Atomizer Dome with Side Air Hole", filed Aug. 25, 2014, and claims priority to and the benefit of Chinese Design Patent Application No. 2014300516158, filed, Mar. 15, 2014, now Chinese Design Patent No. CN 302876554 S issued on Jul. 9, 2014, the disclosures of which are incorporated herein by reference. This application is also a continuation in part of and claims priority to and the benefit of U.S. Design patent application Ser. No. 29/500,466, entitled "Atomizer Dome with Side Air Hole", filed Aug. 25, 2014, and claims priority to and the benefit of Chinese Design Patent Application No. 2014300516139, filed, Mar. 15, 2014, now Chinese Design Patent No. CN 302876552 S issued on Jul. 9, 2014, the disclosures of which are incorporated herein by reference.

FIELD OF INVENTION

The presently described invention relates generally to personal vaporizers or vaporizing devices which heat solid concentrates, waxes, herbs or essential oils into vapors and or aerosol which are inhaled by the vaporizer user. More specifically, it relates to a new way to introduce air into an atomizer or atomizer compartment of a vaporizing device. In particular, the invention resides in the use of a side air inlet hole through the atomizer cover, also referred to as the atomizer dome, located near the atomizer and atomizer base, at or below the atomizer cup level, which creates a vortex of air to increase the efficiency in the pulling of the aerosol from within the atomizer cover, while cooling down the aerosol or vapor which is then inhaled by the user. This vortex also cools down the atomizer, allowing for a hotter-running atomizer to work.

BACKGROUND

The earliest electronic cigarette can be traced to Herbert A. Gilbert, who in 1963 patented a device described as "a smokeless non-tobacco cigarette" that involved "replacing burning tobacco and paper with heated, moist, flavored air." U.S. Pat. No. 3,200,819. This device heated the nicotine solution and produced steam. It was never commercialized.

Hon Lik, a Chinese pharmacist, is credited with the invention of the modern electronic cigarette. In 2003, he came up with the idea of using a piezoelectric ultrasound-emitting element to vaporize a pressurized jet of liquid containing nicotine diluted in a propylene glycol solution. This design produces a smoke-like vapor that can be inhaled and provides a vehicle for nicotine delivery into the bloodstream via the lungs. He also proposed using propylene glycol to dilute nicotine and placing it in a disposable plastic cartridge which serves as a liquid reservoir and mouthpiece.

The electronic cigarette ("e-cigarette") continued to evolve from the first generation three-part device. In 2006, the "cartomizer" (an amalgamation of cartridge and atomizer) was invented by British entrepreneurs Umer and Tariq Sheikh of XL Distributors. This is a mechanism which integrates the heating coil into the liquid chamber. The new device was launched in the United Kingdom in 2007 and is now widely adopted by the majority of 'cigalike' brands.

The grant of the United Kingdom patent for the "cartomizer" was made in February 2013. UK Patent No. GB 2,465,247.

Standard vaporizing devices are comprised of four main parts: the battery, the atomizer, the atomizer base, and the atomizer cover. The atomizer has a bowl (called atomizer bowl or ceramic bowl), and the atomizer base connects to the battery. The atomizer base attaches the atomizer to the battery and provides the power bridge from the battery into the atomizer. When a user inhales or when user presses a button, a microprocessor signals the battery to charge the atomizer.

Vaporizing devices work by using a battery to power a small heating element in the atomizer which heats essential oils, and/or solid concentrates such as wax and dry herbs. The tip of the vaporizing device is placed in the user's mouth. The user's inhale breath allows air to flow through the atomizer which in turn creates vapor or an aerosol out of the essential oils and/or solid concentrates that are heated and vaporized by the atomizer.

In standard vaporizing devices, to create this aerosol or vapor, air flows through the center of the atomizer bowl, and this air typically travels from between the battery and the atomizer base, or through the side of the base, to a hole in the center of the atomizer base, to the atomizer through the center of the atomizer bowl. The problem with this is that, usually, with very little use, the hole which runs through the center of the atomizer bowl gets clogged up by oils or solid concentrates, or burnt remnants thereof, thereby blocking the hole and obstructing or preventing air flow through the hole. Many times oils will leak through this hole in the atomizer down to the top of the battery where eventually this oil will seep into the battery and cause failure of the battery.

Thus, there is a need for improvement on the efficiency of the current method for delivery of the aerosol or vapor to the user. The present invention provides a new way for air to enter the vaporizing device and more effectively flow over the atomizer to provide a more efficient manner for the aerosol or vapor to reach the user's mouth, while simultaneously cooling the aerosol or vapor during delivery. This vortex also cools down the atomizer allowing for a hotter-running atomizer to work.

SUMMARY

The presently described invention relates generally to the atomizer cover or atomizer dome of a vaporizing device.

In the present invention, the atomizer cover has a side air inlet hole along the side, near the base, close to the location of the atomizer. This element of the atomizer cover is a novel feature of the vaporizing device.

The side air inlet hole through the atomizer cover can be either straight or angled. The side air inlet hole increases the amount of air able to enter the atomizer cover during use of the vaporizing device. The additional air creates a vortex of air rushing into the atomizer cover. This vortex of air simultaneously circulates around the atomizer, increasing the burn rate of the essential oils or solid concentrates which are vaporized, and provides a cooling effect of the aerosol or vapor prior to it leaving the vaporizing device and being delivered to the user's mouth.

The atomizer cover can be made of glass, plastic, silicone, metal, or metal which is glass-lined. The tip of the atomizer cover which goes into the user's mouth can either have a curvature with a lip, or can be angled to be held between the user's lips. Both designs have openings for the aerosol or vapor to leave the vaporizing device and enter the user's mouth.

An alternative embodiment of the present invention has a side air inlet hole with a one-way valve to prevent liquids from escaping, but still allows air into the atomizer cover through the side air inlet hole. This alternative embodiment also has a one-way valve at the opening used by the user to draw the vapor leaving the vaporizing device.

Another alternative embodiment has a side air hole on the side of the atomizer body. This hole is on the side of the atomizer between the bowl (ceramic cup) and the bottom of the atomizer where it connects to the atomizer base. This hole brings in air via the bottom of the atomizer, through the atomizer base, which air comes from between the base and the battery. This alternative can be used with the side air hole in the atomizer cover as described above, or on its own. This method of bringing in air will also cause a vortex of air rushing into the atomizer cover which simultaneously circulates around the atomizer, increasing the burn rate of the essential oils or solid concentrates, and providing a cooling effect of the aerosol or vapor prior to it leaving the vaporizing device.

Another alternative embodiment has an air hole through a bottom portion (or the distal end) of the atomizer base. Air flow will come from between the battery and the atomizer base, or the side of the atomizer base, and through the bottom portion of the atomizer base between the atomizer the atomizer cover. This air will then enter the atomizer cover compartment. This alternative can be used with the side air hole in the atomizer cover as described above, or on its own. This method of bringing in air will also cause a vortex of air rushing into and thru the atomizer cover, which simultaneously circulates around the atomizer, increasing the burn rate of the essential oils or solid concentrates, and providing a cooling effect of the aerosol or vapor prior to it leaving the vaporizing device.

Another alternative embodiment of the atomizer cover of the present invention is removable and can be used with a variety of existing vaporizing devices.

The above summarized features of the atomizer cover with side air inlet hole are provided in order that the detailed description thereof may be better understood, and in order that the advantages of the present systems may be better appreciated. Additional features and embodiments of the systems will be described hereinafter and will form the inventive subject matter supporting the claims appended hereto. In this respect, before explaining at least one embodiment of the invention in detail, it is to be understood that the systems are not limited in application to the details of construction or to the arrangements of the components set forth in the following description or illustrated in the drawings. Rather, the systems may be practiced in numerous forms and embodiments, and of being practiced and carried out in various ways, all within the scope of the present inventions. Also, it is to be understood that the phraseology and terminology employed herein are for the purpose of the description and should not be regarded as limiting.

These and other embodiments, features, aspects, and advantages of the inventive systems will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

DETAILED DESCRIPTION

The presently described invention relates generally to the atomizer cover (110) or atomizer dome of a vaporizing device. A preferred embodiment of the atomizer cover of the present invention is removable and can be used interchangeably with preexisting atomizer covers and is compatible for use with a variety of existing vaporizing devices.

Figure 1:
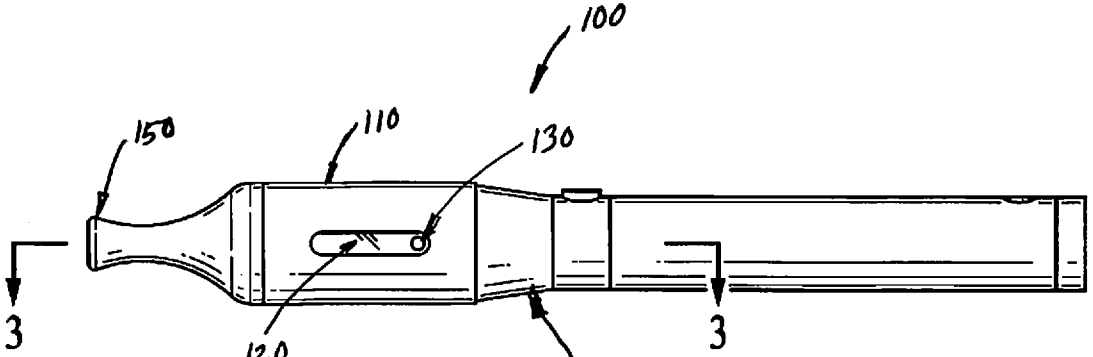
FIG. 1 is a plan view of an assembled vaporizing device with an atomizer cover with an interior lining with a side air inlet hole.

FIG. 1 is a plan view of an assembled vaporizing device (100) with an atomizer cover (110) with an interior lining (120) with a side air inlet hole (130). As shown in FIG. 1, the interior lining (120) has a side air inlet hole (130) located at a lower portion of the interior lining such that the side air inlet hole is visible when the interior lining is fitted (or assembled) into, or made part of the atomizer cover (110).

Figure 2:
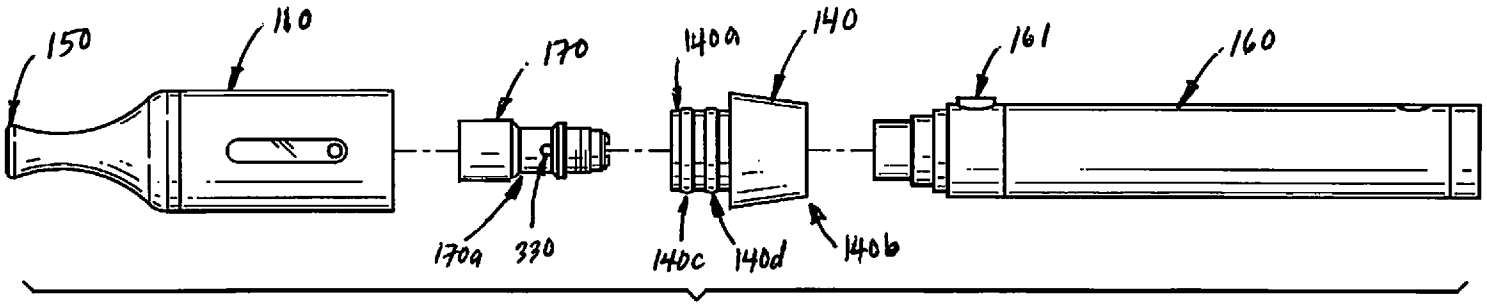
FIG. 2 is an exploded view of the vaporizing device shown in FIG. 1.

FIG. 2 is an exploded view of the vaporizing device (100) shown in FIG. 1. As shown in FIG. 2, the vaporizing device (100) is generally comprised of a battery (160), an atomizer base (140), an atomizer (170), and an atomizer cover (110). The atomizer base (140) has a proximal end (140*a*) and a distal end (140*b*), and preferably has a beveled edge. The atomizer (170) has an atomizer cup (170*a*). The side air inlet hole (130) is preferably located substantially along the same plane as the proximal end (140*a*) of the atomizer base (140), or at or below the atomizer cup (170*a*) when the atomizer cover (110) is placed over the atomizer (170) and the proximal end (140*a*) of the atomizer base and assembled into place. Such assembly can be accomplished by screwing the atomizer cover onto the atomizer base, or by fitting the atomizer cover over rubber o-rings (140*c* and 140*d*) of the atomizer base (140), allowing a tight, sealed fit.

The battery configuration of the vaporizing device can either be manual or automatic. In an automatic configuration, a sensor inside the battery (160) activates when a user begins inhaling, and in a manual configuration, a sensor inside the battery (160) activates when a user presses a button (161). The battery (160) power source is preferably comprised of a lithium ion cell which can be rechargeable such as through use of a USB charger or micro-USB charger, or a wall charger. As shown in FIGS. 1 and 2, the atomizer base (140) attaches the atomizer (170) to the battery (160) and provides the power bridge from the battery (160) into the atomizer (170). When a user inhales, a microprocessor signals the battery (160) to charge the atomizer (170), which heats liquid, wicking materials, essential oils, and/or solid concentrates such as wax and dry herbs.

Figure 3:
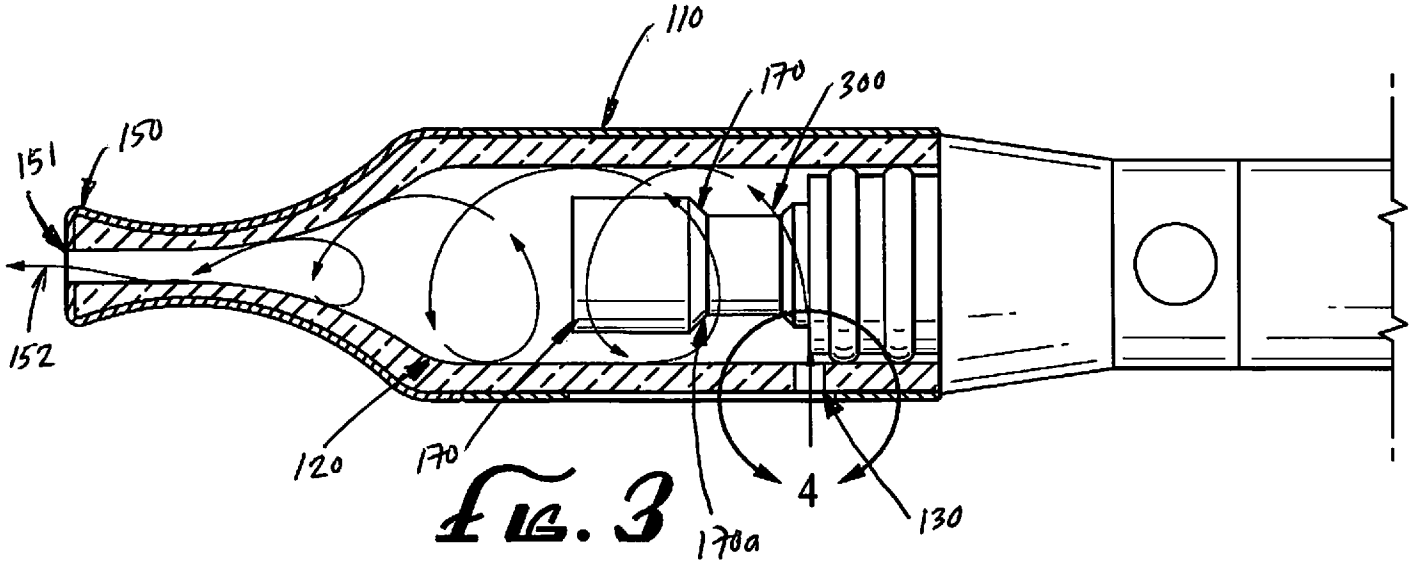
FIG. 3 is a sectional view of the atomizer cover with the interior lining with a side air inlet hole, on larger scale than FIG. 1, taken generally on line 3-3, FIG. 1.

FIG. 3 is a sectional view of the atomizer cover (110) with the interior lining (120) with a side air inlet hole, (130) on larger scale than FIG. 1, taken generally on line 3-3, FIG. 1. The atomizer cover (110) can be made of materials such as glass, silicone, plastic or metal, or glass lined metal. The interior lining (120) of the atomizer cover (110) can also be made of plastic or metal, but glass is preferred. The atomizer cover (110) has a tip (150) which goes into the user's mouth. The tip (150) has an opening (151) which either has a conical curvature with a lip, or angled to be held between the user's lips. Both designs have openings for the aerosol or vapor (152) to leave the atomizer cover interior and enter the user's mouth.

Figure 5:
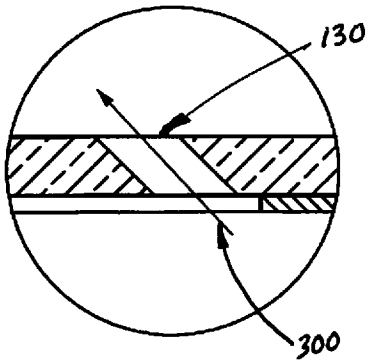
FIG. 5 is a partial view of an alternative embodiment of the side air inlet hole, enlarged for magnification purposes.
Figure 4:
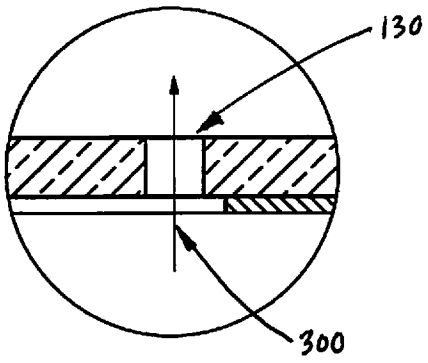
FIG. 4 is a partial view of the atomizer cover with the interior lining with a side air inlet hole shown in FIG. 3, enlarged for magnification purposes.

The side air inlet hole (130) can be straight, as shown in FIG. 4, or angled towards the tip of the atomizer cover, as shown in FIG. 5. The side air inlet hole (130) increases the amount of air able to enter the atomizer cover (110) during use of the vaporizing device (100). As shown in FIG. 3, the additional air creates a vortex of air (300) rushing into the atomizer cover (110). This vortex of air simultaneously wraps around the atomizer (170), increasing the burn rate of the essential oils or solid concentrates which become the aerosol or vapor, and provides a cooling effect of the aerosol or vapor prior to it being delivered to the user's mouth after leaving the interior of the atomizer cover. This vortex also cools down the atomizer, allowing for a hotter-running atomizer to work.

Figure 6:
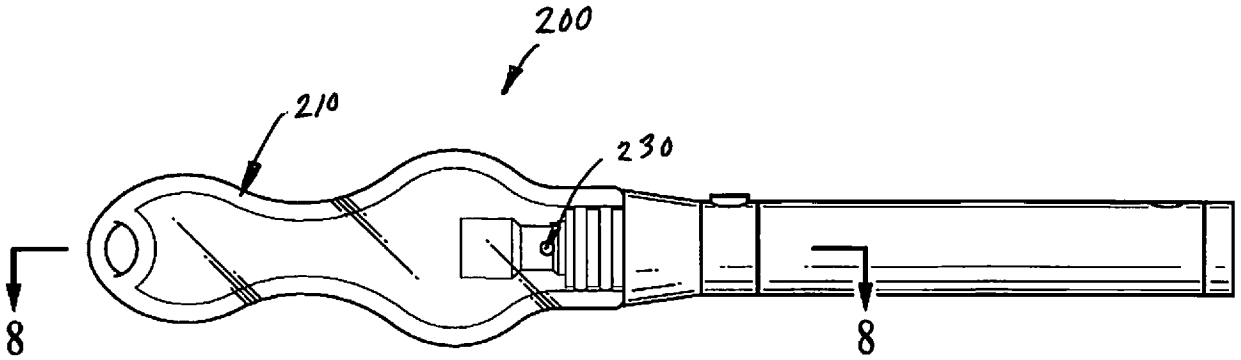
FIG. 6 is a plan view of an assembled vaporizing device with an alternative embodiment of an atomizer cover with a side air inlet hole.

FIG. 6 is a plan view of an alternative embodiment of an assembled vaporizing device (200), with an alternative embodiment of an atomizer cover (210) with a side air inlet hole (230).

Figure 7:
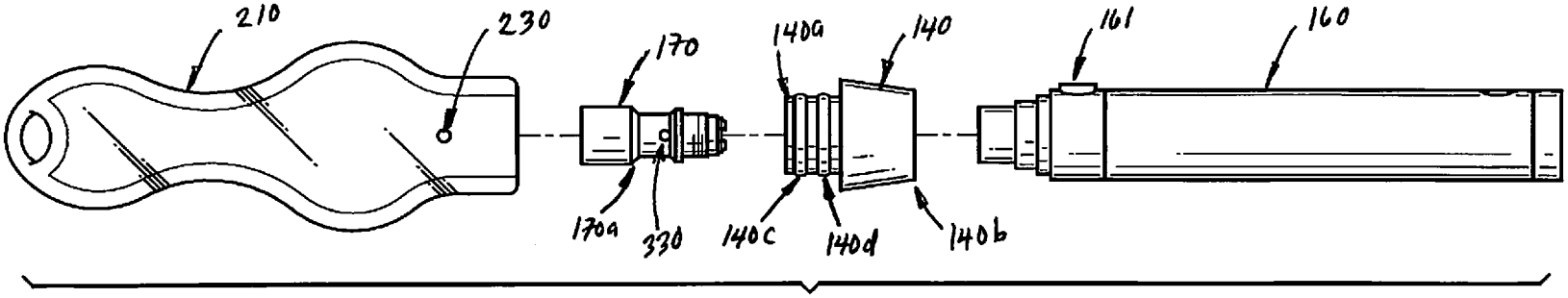
FIG. 7 is an exploded view of the vaporizing device shown in FIG. 6.

FIG. 7 is an exploded view of the vaporizing device (200) shown in FIG. 6. As shown in FIG. 7, the vaporizing device (200) is generally comprised of a battery (160), an atomizer base (140), an atomizer (170), and an atomizer cover (210). The atomizer base (140) has a proximal end (140*a*) and a distal end (140*b*) and preferably has a beveled edge. The atomizer (170) has an atomizer cup (170*a*). The side air inlet hole (230) in this alternative embodiment is preferably located substantially along the same plane as the proximal end (140*a*) of the atomizer base (140), or at or below the atomizer cup (170*a*) when the atomizer cover (210) is placed over the atomizer (170) and the proximal end (140*a*) of the atomizer base, and assembled into place. Such assembly can be accomplished by screwing the atomizer cover onto the atomizer base, or by fitting the atomizer cover over rubber o-rings (140*c* and 140*d*) of the atomizer base (140), allowing a tight, sealed fit.

The battery configuration of the vaporizing device can either be manual or automatic. In an automatic configuration, a sensor inside the battery (160) activates when a user begins inhaling, and in a manual configuration, a sensor inside the battery (160) activates when a user presses a button (161). The battery (160) power source is preferably comprised of a lithium ion cell which can be rechargeable such as through use of a USB charger or micro-USB charger, or a wall charger. As shown in FIGS. 6 and 7, the atomizer base (140) attaches the atomizer (170) to the battery (160) and provides the power bridge from the battery (160) into the atomizer (170). When a user inhales, a microprocessor signals the battery (161) to charge the atomizer (170), which heats liquid, wicking materials, essential oils, and/or solid concentrates such as wax and dry herbs.

Figure 8:
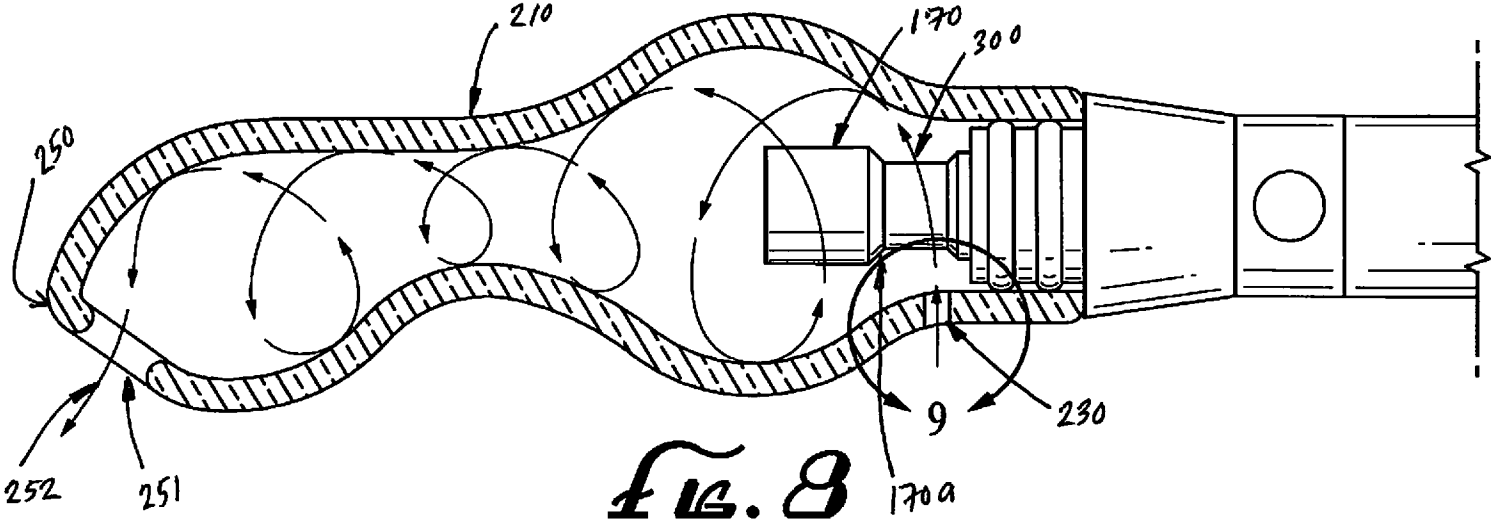
FIG. 8 is a sectional view of the alternative embodiment of an atomizer cover with a side air inlet hole, on larger scale than FIG. 6, taken generally on line 8-8, FIG. 6.
Figure 9:
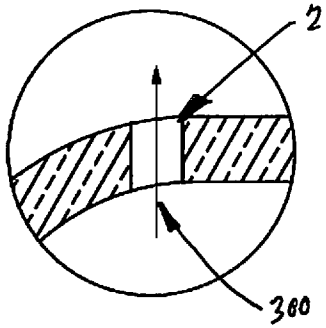
FIG. 9 is a partial view of the alternative embodiment of an atomizer cover with side air inlet hole shown in FIG. 8, enlarged for magnification purposes.

FIG. 8 is a sectional view of the atomizer cover (210) with a side air inlet hole, (230) on larger scale than FIG. 6, taken generally on line 8-8, FIG. 1. The atomizer cover (210) in this alternative embodiment is preferably made of glass. The atomizer cover (210) has a tip (250) which touches the user's mouth. The tip (250) has an opening (251) which either has a conical curvature with a lip. The aerosol or vapor (252) leaves the atomizer cover interior and enters the user's mouth through the opening (251).

Figure 10:
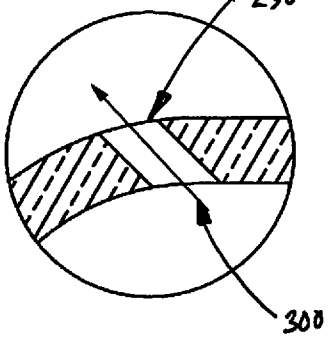
FIG. 10 is a partial view of the alternative embodiment of a side air inlet hole of an atomizer cover, enlarged for magnification purposes.

The side air inlet hole (230) can be straight, as shown in FIG. 49 or angled towards the tip of the atomizer cover, as shown in FIG. 10. The side air inlet hole (230) increases the amount of air able to enter the atomizer cover (210) during use of the vaporizing device (200). As shown in FIG. 8, the additional air creates a vortex of air (300) rushing into the atomizer cover (210). This vortex of air simultaneously wraps around the atomizer (170), increasing the burn rate of the essential oils or solid concentrates which become the aerosol or vapor, and provides a cooling effect of the aerosol or vapor prior to it being delivered to the user's mouth after leaving the interior of the atomizer cover. This vortex also cools down the atomizer, allowing for a hotter-running atomizer to work.

Another alternative embodiment of the present invention has an air inlet hole (330) through the side of the atomizer (170), as shown in FIGS. 2 and 7. By placing the air inlet hole on the side rather than at the center of the atomizer bowl as in existing vaporizers, this prevents the air inlet hole from being clogged up by oils or solid concentrates, debris or burnt remnants, but still allows air into the atomizer cover (110 or 210). This hole brings in air via the bottom of the atomizer (170), through the atomizer base (140), which air comes from between the base (140) and the battery (160). This alternative can be used with the side air hole in the atomizer cover as described above, or on its own. This method of bringing in air will also cause a vortex of air rushing into the atomizer cover which simultaneously circulates around the atomizer, increasing the burn rate of the essential oils or solid concentrates, and providing a cooling effect of the aerosol or vapor prior to it leaving the vaporizing device.

Another alternative embodiment has an air hole through a bottom portion (or distal end (140*b*)) of the atomizer base (140). Air flow will come from between the battery (160) and the base (140), or the side of the base, and through the bottom portion (or distal end) of the atomizer base. This air will then enter a compartment of the atomizer which is located on the side of a bottom portion of the atomizer (170), within the base (140) and below the atomizer cup (170*a*). This alternative can be used with the side air hole in the atomizer cover as described above, or on its own. This method of bringing in air will also cause a vortex of air rushing into the atomizer cover which simultaneously circulates around the atomizer, increasing the burn rate of the essential oils or solid concentrates, and providing a cooling effect of the aerosol or vapor prior to it leaving the vaporizing device.

The above summarized features of the present invention are provided so that the detailed description thereof may be better understood, and so that the advantages of the present systems may be better appreciated. Additional features and embodiments of the systems will be described hereinafter and will form the inventive subject matter supporting the claims appended hereto. In this respect, before explaining at least one embodiment of the invention in detail, it is to be understood that the systems are not limited in application to the details of construction or to the arrangements of the components set forth in the following description or illustrated in the drawings. Rather, the invention may be practiced in numerous forms and embodiments, and of being practiced and carried out in various ways, all within the scope of the present inventions. Also, it is to be understood that the phraseology and terminology employed herein are for the purpose of the description and should not be regarded as limiting.

These and other embodiments, features, aspects, and advantages of the invention will become better understood with regard to the following description, appended claims and accompanying drawings.

Although specific embodiments of the present invention have been described, various modifications, alterations, alternative constructions, and equivalents are also encompassed within the scope of these inventions.

The specification and figures are, accordingly, to be regarded in an illustrative rather than a restrictive sense. It will, however, be evident that additions, subtractions, deletions, and other modifications and changes may be made thereunto without departing from the broader spirit and scope of the inventions as set forth in the claims.

The invention claimed is:

1. A vaporizing device assembly comprising:
a battery;
an atomizer base, an atomizer, and an atomizer cover;
wherein said atomizer base is assembled onto said battery, and wherein said atomizer is assembled onto said atomizer base;
wherein said atomizer has an atomizer cup;
wherein said atomizer cover has a side air inlet hole and a tip having an opening;
wherein said side air inlet hole is adjacent to a bottom of said atomizer cup upon assembly of said atomizer cover over said atomizer cup;
wherein air entry into said vaporizing device is solely through said side air inlet hole of said atomizer cover.

2. The vaporizing device assembly of claim 1 wherein said side air inlet hole is angled towards said tip of said atomizer cover.

3. The vaporizing device assembly of claim 1, wherein said atomizer cover is made of glass material.

4. The vaporizing device assembly of claim 1, wherein said atomizer has an air inlet hole located on a side of said atomizer adjacent to said atomizer cup.

5. The vaporizing device assembly of claim 1 wherein said atomizer cover is removable from said atomizer base.

6. The vaporizing device assembly of claim 1 wherein said atomizer base has a beveled edge.

7. The vaporizing device assembly of claim 1 wherein said air inlet hole is located at a distal end of said atomizer base.

8. A vaporizing device assembly comprising:
a battery;
an atomizer base, an atomizer, and an atomizer cover;
wherein said atomizer base is assembled onto said battery, and wherein said atomizer is assembled onto said atomizer base;
wherein said atomizer has an atomizer cup;
wherein said atomizer cover has an interior lining and a tip having an opening, and wherein said interior lining has a side air inlet hole;
wherein said side air inlet hole is adjacent to a bottom of said atomizer cup upon assembly of said atomizer cover over said atomizer cup;
wherein air entry into said vaporizing device is solely through said side air inlet hole of said interior lining.

9. The vaporizing device assembly of claim 8, wherein said side inlet hole is angled towards said tip of said atomizer cover.

10. The vaporizing device assembly of claim 8, wherein said atomizer cover is made of metal, and wherein said interior lining of said atomizer cover is made of glass.

11. The vaporizing device assembly of claim 8, wherein said atomizer has an air inlet hole located on a side of said atomizer, below said atomizer cup.

12. The vaporizing device assembly of claim 8, wherein said atomizer cover is removable from said atomizer base.

13. The vaporizing device assembly of claim 8 wherein said atomizer base has a beveled edge.

14. The vaporizing device assembly of claim 8 wherein said air inlet hole is located at a distal end of said atomizer base.

15. An atomizer cover comprising:
an interior lining;
a tip having an opening;
wherein said interior lining has a side air inlet hole located at a lower portion of said interior lining such that said side air inlet hole is visible through said atomizer cover;
wherein said side air inlet hole is adjacent to a bottom of an atomizer cup upon assembly of said atomizer cover over said atomizer cup;
wherein air entry upon assembly of said atomizer cover over said atomizer cup is solely through said side air inlet hole of said interior lining.

16. The atomizer cover of claim 15, wherein said side air inlet hole of said interior lining is angled towards said tip of said atomizer cover.

17. The atomizer cover of claim 15 wherein said atomizer cover is made of metal, and wherein said interior lining of said atomizer cover is made of glass.

18. The atomizer cover of claim 15, wherein said atomizer cover is removable and is capable of being used with existing vaporizing devices.

19. An atomizer cover comprising:
a tip having an opening;
a side inlet hole located at a lower portion of said atomizer cover;
wherein said side air inlet hole is adjacent to a bottom of an atomizer cup upon assembly of said atomizer cover over said atomizer cup;
wherein said side inlet hole is angled towards said tip;
wherein air entry upon assembly of said atomizer cover over said atomizer cup is solely through said side air inlet hole of said atomizer cover.

20. The atomizer cover of claim 19, wherein said atomizer cover is made of glass.

21. The atomizer cover of claim 19, wherein said side air inlet hole is straight.

22. The atomizer cover of claim 19, wherein said atomizer cover is removable and is capable of being used with existing vaporizing devices.

* * * * *